United States Patent [19]

Backteman

[11] 4,202,643

[45] May 13, 1980

[54] SOLID CONTAINER COUPLING DEVICE

[76] Inventor: Hans U. Backteman, Lusthusbacken 14, 161 39 Bromma, Sweden

[21] Appl. No.: 942,919

[22] Filed: Sep. 18, 1978

[30] Foreign Application Priority Data

Sep. 27, 1977 [SE] Sweden ..... 7710804

[51] Int. Cl.[2] ..... F16C 11/00; F16D 1/12; F16D 3/00

[52] U.S. Cl. ..... 403/33; 403/323; 220/23.4

[58] Field of Search ..... 403/33, 323, 294; 220/23.4, 23.6; 24/221 R, 81 E; 105/463, 464, 465, 366 B, 366 C; 280/179 R, 179 B; 296/33, 34, 40

[56] References Cited

U.S. PATENT DOCUMENTS

| | | | |
|---|---|---|---|
| 3,469,865 | 9/1969 | Ellenburg | 403/294 X |
| 3,711,902 | 1/1973 | Eggert | 24/81 E |
| 3,718,218 | 2/1973 | Shields | 220/23.4 X |
| 3,722,714 | 3/1973 | Morris et al. | 105/366 B X |
| 4,082,052 | 4/1978 | Looks | 24/81 E X |

*Primary Examiner*—Wayne L. Shedd
*Attorney, Agent, or Firm*—Witherspoon & Hargest

[57] ABSTRACT

A coupling device for containers adapted to retain the containers in a correct position in relation to each other and/or the walls in the holds of a ship wherein a turnable shaft having a locking head at each end thereof facing in opposite directions and being angularly displaced in relation to each other in turnable through three distinct positions by means of an operating handle to lock the device in place.

6 Claims, 7 Drawing Figures

SOLID CONTAINER COUPLING DEVICE

Figure 1:
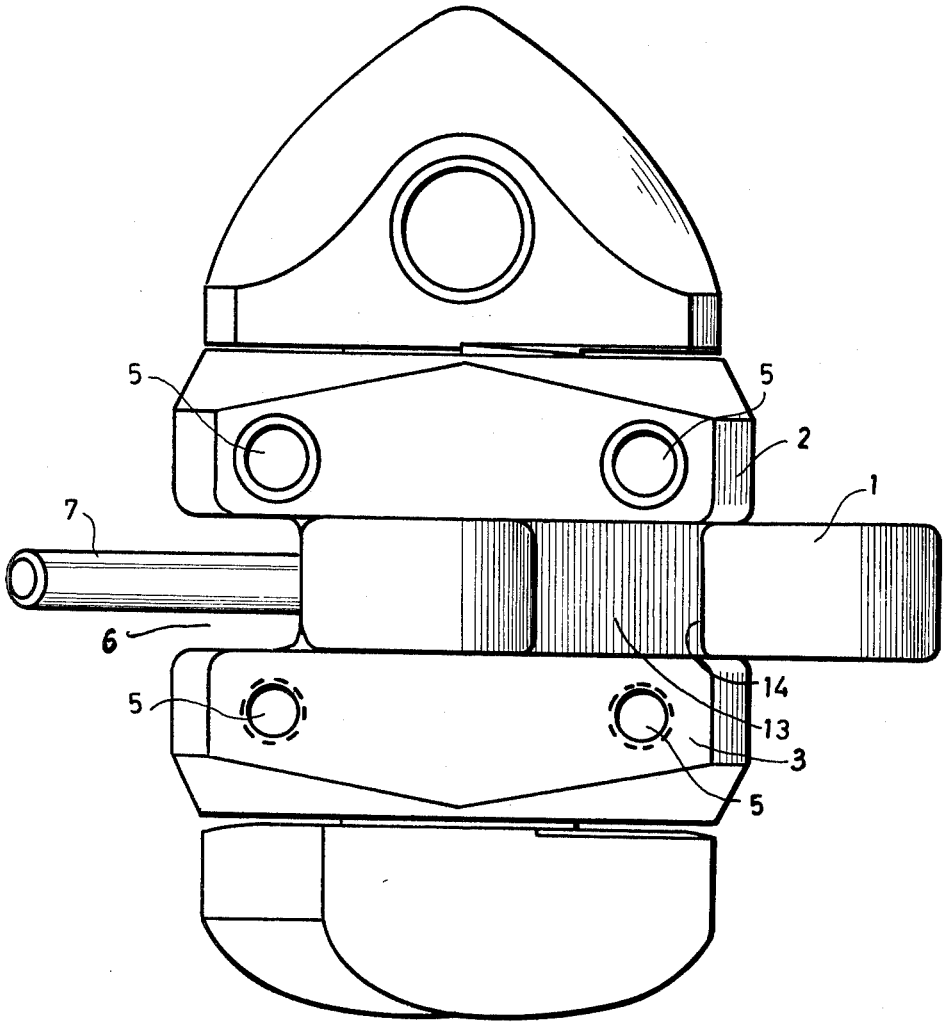

Generally speaking this invention refers to coupling devices for containers, the invention specifically relating to coupling devices for containers adapted to retain the containers in a correct position in relation to each other and/or the walls in the holds of a ship.

During the first time of development of the container transport system specific holds were built in the ships designed for container traffic, said holds comprising a plurality of so-called cells in which corner supports or corner columns were provided at the outer contour of the container stacks; during loading each individual container was guided into and out of these cells to cause the corner supports to sustain the horizontal loads during the travel of the ship. Due to the hight of the holds and the good side force absorption offered by the cells it was possible to place up to eight containers upon each other there. In these cells all containers are loosely positioned upon each other in the vertical direction. However, as the provision of such specific cells restricted the use of the container ships exclusively to the shipping of containers, it very soon became desirable to lash the containers in a self-supporting manner because the cargos very often were mixed and comprised in addition to container also single consignments; thus it became an urgent desideratum to be able to load containers only in parts of the holds and preferably at an arbitrary place there.

Lashing systems were then invented permitting self-supporting stacking of containers which were interconnected in a vertical direction with each other and the underlying floor with the aid of various coupling devices, such as automatic couplings (compare for example the construction according to our Swedish Pat. No. 368 945) or manually operated devices (compare for example our Swedish Pat. No. 355 008). Forces acting in a horizontal direction have been absorbed with the aid of bridge fittings and cross-laid ropes in such systems.

Even if the above indicated systems as well as certain of the previously proposed arrangements have been successful in many respects, there have been certain drawbacks limiting their applicability.

Due to the fact that the containers are of standard construction, there are requirements regarding their ability to sustain loads; in a vertical direction they must be able to support a load of 810 kN (i.e. 82 ton) whereas in the horizontal direction they shall be able to resist 150 kN (i.e. 15.2 ton). This means that in connection with self-supporting stacking in covered holds it has been possible to pile four containers upon each other by making use of top-lashing against the roof of the holds, whereas on the upper deck not more than two loaded and one unloaded container could be stacked upon each other. The width of the container stack must be increased to yield the necessary load absorbing capacity which has been achieved with the aid of cross-laid lashing ropes. These systems of lashing ropes must be given a certain pre-loading force and for this reason rigging screws have been used. This type of lashing, obviously, is expensive both in respect to prime costs and in particular in use due to the time-consuming manipulation and the necessity of storage and handling of the great amount of relevant various types of lashing implements; in addition the lashing effect is difficult to calculate and will be unequal from one case to the other because different dockers will tension the ropes in different degrees with the aid of the rigging screw. Finally, the container stacks will have to be placed at such a mutual distance in the longitudinal direction that there is sufficient space for the various lashing implements used. Obviously, this means that the container stacks will be placed at relatively great distances from each other longitudinally and, accordingly, the technique used at present and involving positioning the container stacks at a distance of 279 mm from each other cannot be used as no sufficient spacing will be obtained thereby.

The above described drawbacks may be eliminated and other advantages obtained in accordance with the present invention which serves the purpose to provide such an arrangement for coupling containers which brings about mutual horizontal locking of container stacks without the provision of cells and the use of lashing ropes with appertaining rigging screws. By the invention it is possible, for example, to load container stacks on only one side of a hold whereas the other side of the hold can be loaded with single consignment goods. The invention also permits horizontal locking at the side-wall of the hold which is an important feature, for example, in connection with loading holds having partition walls of a type not permitting absorption of horizontal stresses.

The features specifically characterizing the invention so that the above specific purposes are achieved will appear from the attached claims.

Figure 2:
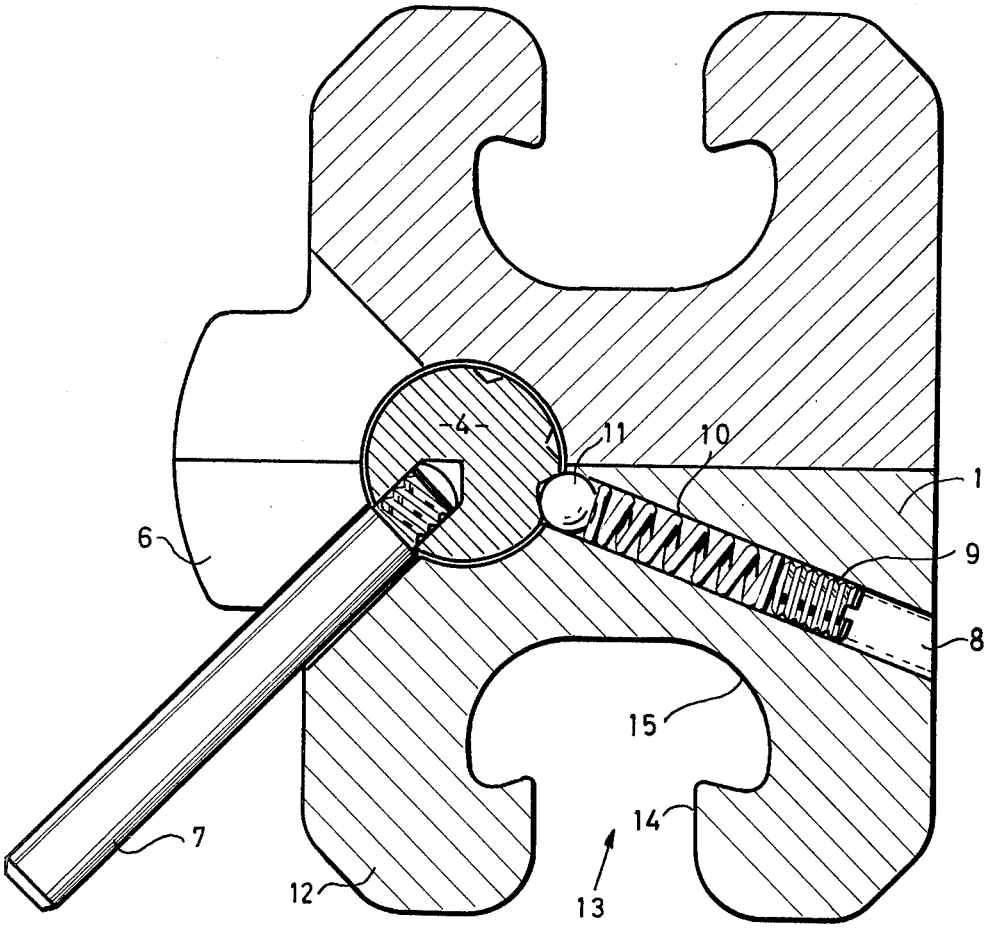
Figure 3A:
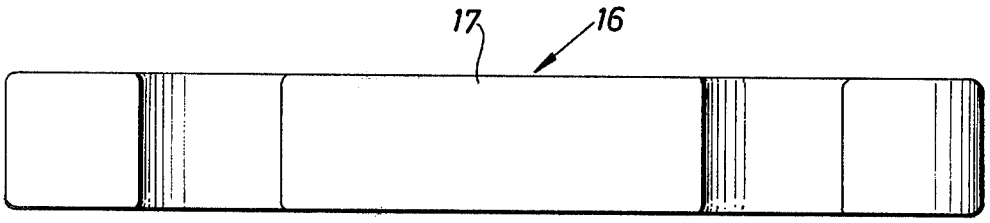
Figure 3B:
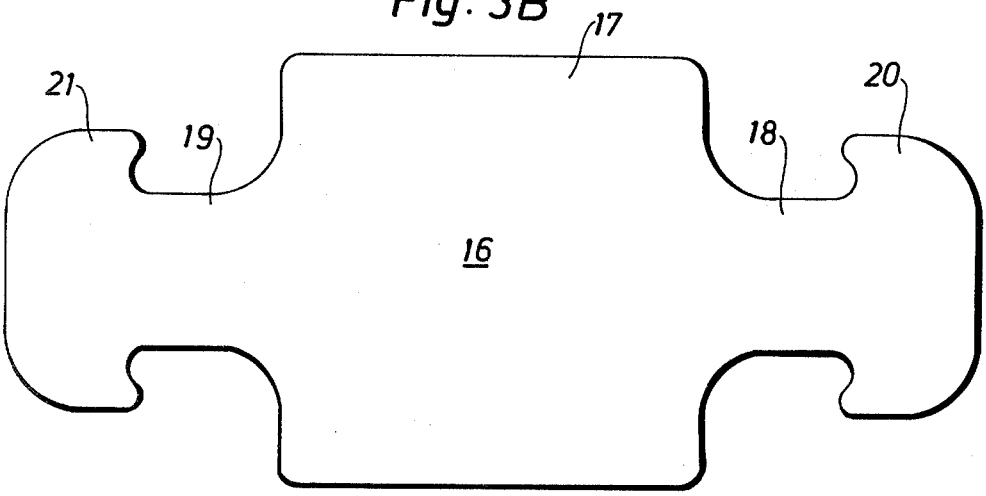
Figure 4A:
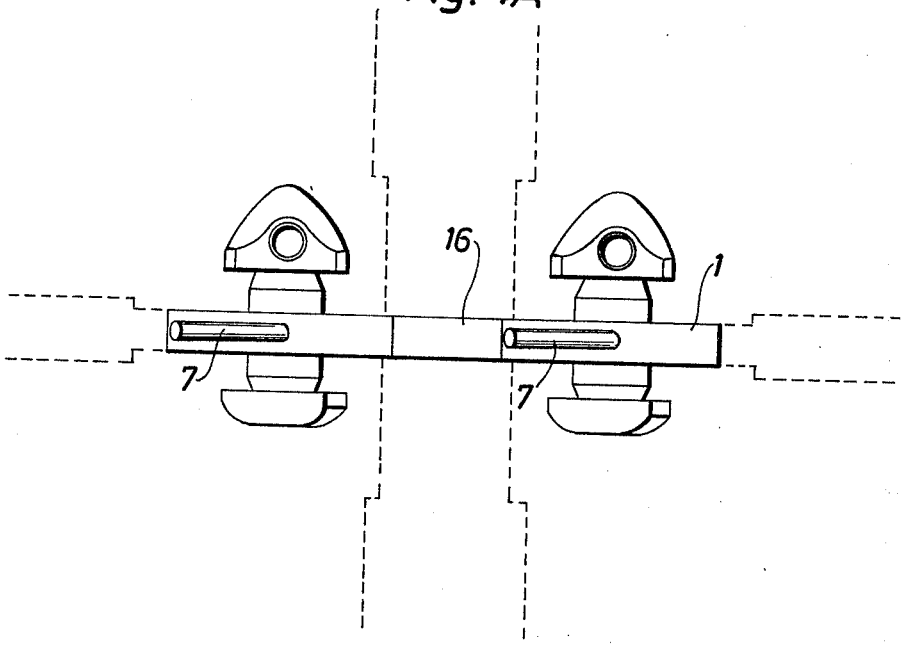
Figure 4B:
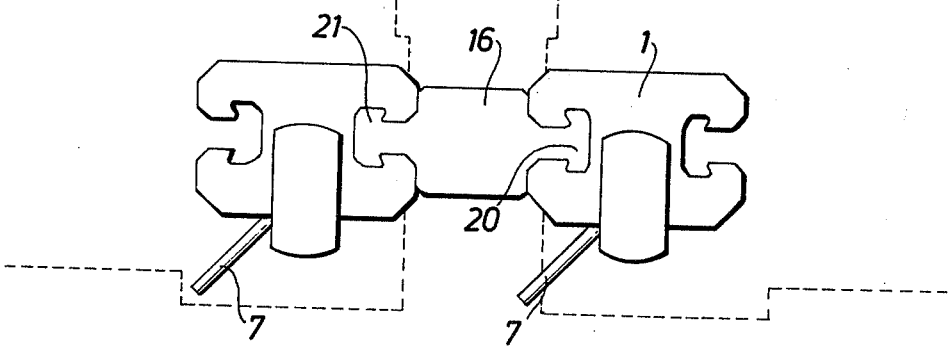
Figure 5:
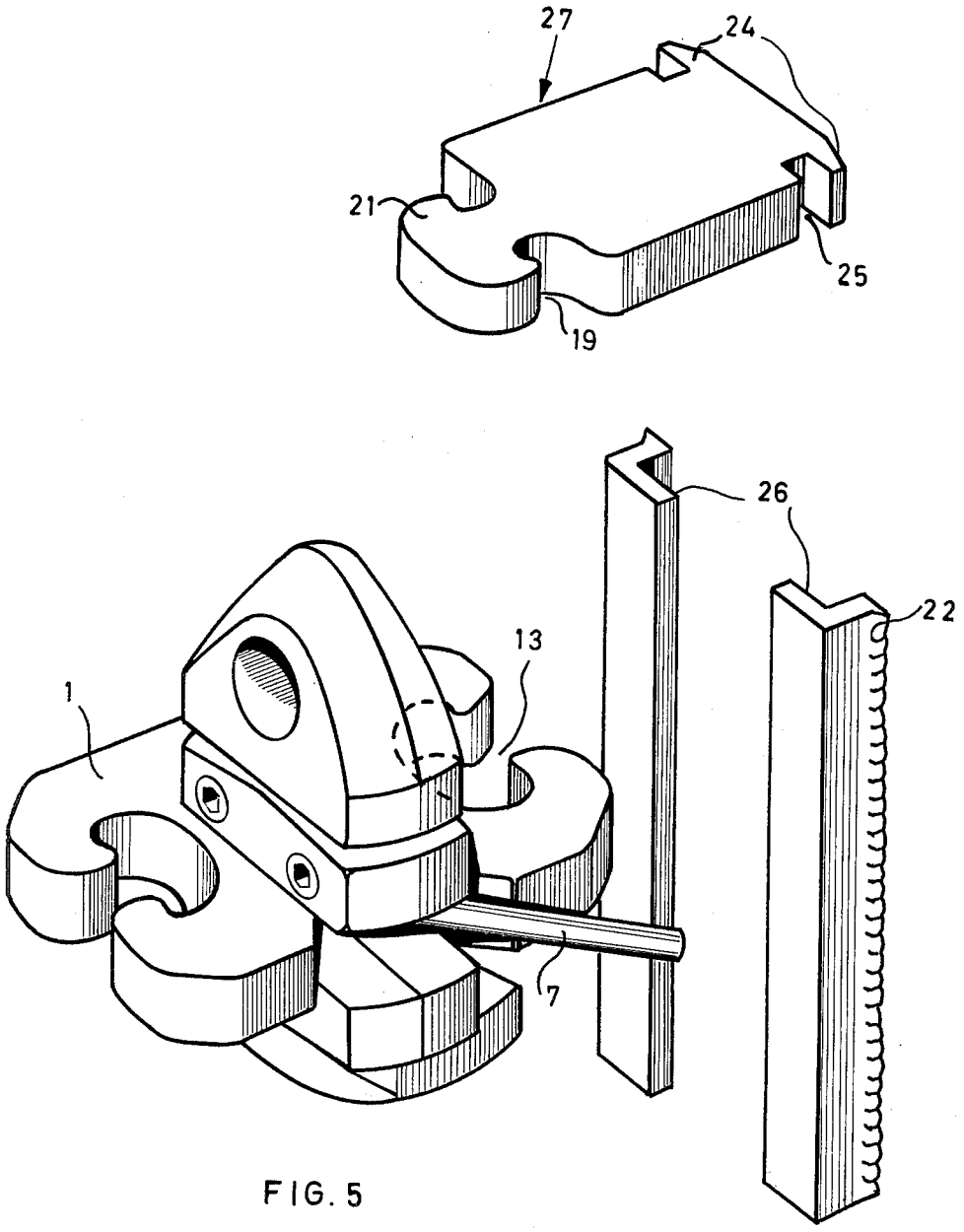

The invention will be described hereafter by reference to certain presently preferred embodiments illustrated in the attached drawings in which FIG. 1 is a side elevation of the device according to the invention, FIG. 2 is a horizontal cross-sectional view of the central portion of the device shown in FIG. 1, FIGS. 3*a* and 3*b* are respectively elevations and upper plan views of a solid coupling plate according to the invention, FIGS. 4*a* and 4*b* are respectively an elevation and a plan view schematically showing the invention when used for locking-together in adjacent stacks of containers, and FIG. 5 is a perspective view of the invention when used for horizontal coupling of the outermost container stack to the hold wall in a ship.

FIGS. 1 and 2 illustrate a container coupling comprising a solid, non-compressible body 1 on the upper and lower sides of which filler pieces 2 and 3 are attached. Through body 1 and filler pieces 2, 3 a cylindrical recess 4 extends (compare FIG. 2) receiving a through-shaft, on the outer ends of which locking heads are attached, these locking heads preferably being angularly displaced in relation to each other to enable the locking device to be suspended below the lower corner box of a suspended container with the free locking head correctly directed for insertion into the upper hole of the upper corner box of an underlying container during the connecting operation. As appears from FIG. 1 the filler pieces 2 and 3 have through-holes 5 adapted to receive mounting bolts serving to clamp together two halves forming the device (compare FIG. 2).

FIG. 2 shows that the solid body 1 which will not yield to any compacting pressure, comprises two symmetrical halves. The cylindrical recess 4 for receiving the through-shaft is disposed in the central line of division of body 1 where the halves lie side by side in mounted condition. In an operating aperture an operating handle 7 connected to the through-shaft can move freely without risk of jamming because the solid body 1 sustains any existing pressure forces. In a bore 8 an adjustment screw 9 is adapted to tension a holding spring 10 acting on a locking ball 11, said ball being adapted lockingly to retain the through-shaft 4 and thereby also the two locking heads in any of three possible positions of use.

The solid body of the locking device according to the invention has been given a very specific shape. In its outwardly facing free portion 12 a recess 13 is provided having in the embodiment shown an opening portion 14 and an internal enlarged portion 15. Recess 13 thereby is given essentially the shape of an arrowhead for reasons to be explained hereafter. Any expert on the present field will appreciate that instead of the "female" recess 13 a "male" protrusion may be used if desired.

FIG. 3 illustrates a coupling plate adapted to cooperate with the container coupling according to FIGS. 1 and 2. The coupling plate 16 is solid and in its presently preferred shape has a thickness essentially corresponding to that of body 1 of the container coupling. On either side of a large central portion 17 extend reduced end portions 18 and 19 respectively. Outwardly continuing the reduced end portions are protrusions 20 and 21 respectively having the shape of arrowheads complementary to the shape of the recesses 13 in the body 1 of the container coupling. In addition to cooperating with the container body one of the protrusions may also be in engagement with a keyhole-shaped recess or a vertical notch in the side-wall of the hold to bring about a side-wall locking to be described in detail subsequently by reference to FIG. 5.

FIGS. 4*a* and 4*b* illustrate in respectively side elevation and plan view how the container coupling cooperates with the coupling plate 16. When container stacks are built adjacent each other container couplings according to the invention are inserted into the upper holes of the adjacent upper corner boxes. Thereafter a coupling plate 16 is inserted in such a way that the two arrowtip-like protrusions 20 and 21 thereof engage the corresponding recesses 13 in the adjacent container couplings. When subsequently the upper container has been lowered during loading and the operating handles 7 have been turned to the locking position, the upper container obviously will prevent the locking plate 16 from leaving the recess 13 in the container lock. The coupling plate 16 will then provide a horizontal spacing between the adjacent container stacks and also absorbe the horizontal forces appearing during use. Hereby the above indicated possibility will be provided to ship container stacks by means of the invention both in holds of the ship not provided with cells and as self-supporting stacks on the deck irrespective of the considerable horizontal forces appearing during shipping. The expert on the field will appreciate that the vertical forces formed will be absorbed by the container lock, locking itself due to the rigidly connected elements thereof comprising the through-shaft and the two locking heads facing in opposite directions.

FIG. 5 illustrates the use of the invention in connection with the horizontal anchoring of a container stack at the side-wall of a ship hold. A slide guide 22 is attached to the side-wall such as by welding and a side-wall locking element 27 is adapted to be inserted into the slide guide 22 by means of a portion 24 corresponding to the guide track of the slide guide 22. A portion 25 of lesser diameter occupies the space between the flanges 26 of the slide guide 22 forming the opening of the slide guide. An arrowhead-shaped protrusion 21 having a shape complementary to that of recess 13 in the body of the container lock 1 is provided on the locking plate 27. When the side-wall locking element 27 is inserted into the slide guide 22, which in turn is attached to the side-wall of the ship hold, and the arrowhead-shaped protrusion 21 is inserted into recess 13 of a container lock positioned into the upper corner box of a container disposed most closely to the side-wall of the ship hold, a horizontal locking of the container stack to the side-wall of the ship holds is obtained. This means that a satisfactory horizontal locking is obtained for the container stacks to enable containers to be loaded in only a part of the ship holds whereas for example single consignment goods can be loaded in the remaining part of the holds.

According to the invention an upper coupling plate can be shaped in a slightly modified way to be used for horizontally locking together the two uppermost containers in two adjacent container stacks. Two container locks according to the invention in this case are positioned adjacent to each other in the adjacent upper holes of the outer corner boxes in the container stacks. Thereafter a coupling plate is inserted into the space between the container corner boxes, this coupling plate having outwardly extending edge flange portions which in the position of use will be close to the protruding filler pieces 2 of the container lock. When therefter the operating handles 7 of the container locks are moved to the locking position, the upper turning heads of the container locks will be turned to a position above the protruding side flanges. Hereby the upper parts of the container stacks will be horizontally locked together.

Even if the invention above has been described substantially by reference to the presently preferred embodiments illustrated in the drawings, the expert will appreciate that many variations and modifications may be made within the basic idea of the invention as defined in the attached claims. Thus, as pointed out above, the body 1 of the container lock could be provided with "male" protrusions whereas in this case the coupling plate 16 may be provided with "female" recesses. The same applies obviously to the side-wall locking system according to FIG. 5.

What we claim is:

1. Container coupling having a central body including an operating aperture, a turnable shaft extending through said body and provided with a locking head at each end thereof, said heads facing in opposite directions and being sufficiently angularly displaced in relation to each other to enable said heads to selectively sequentially engage respective sockets of adjacent containers, filler pieces provided between said body and said locking heads, said body being provided with side locking means adapted lockingly to cooperate with complementary shaped side locking means in horizontal locking elements, and an operating handle extending into said operating aperture and being connected to said turnable shaft for turning said shaft and said locking heads through three distinct positions to thereby cause said sequential engagement of said head with said respective sockets of said adjacent containers.

2. Container coupling as claimed in claim 1, characterized in that the side locking means are arrowtip-shaped recesses in the body adapted to cooperate with arrowtip-shaped protrusions in said horizontal locking element.

3. Container coupling as claimed in claim 1, characterized in that the side locking means are arrowtip shaped protrusions of the body adapted to cooperate with arrowtip shaped recesses in said horizontal locking elements.

4. Container coupling as claimed in claim 1, characterized in that the said horizontal locking element is a plate.

5. Container coupling as claimed in claim 1, characterized in that said horizontal locking element is a side-wall lock having mounting means adapted to cooperate with slide guides attached to the side-wall of a ship hold.

6. Container coupling as claimed in claim 1, characterized in that said horizontal locking element is a top plate having outwardly extending locking flanges provided at the end portions thereof.

* * * * *